US007119787B2

(12) United States Patent
Yamaguchi et al.

(10) Patent No.: US 7,119,787 B2
(45) Date of Patent: Oct. 10, 2006

(54) IMAGE DISPLAY DEVICE

(75) Inventors: Yoshiro Yamaguchi, Ashigarakami-gun (JP); Yasufumi Suwabe, Ashigarakami-gun (JP); Yoshinori Machida, Ashigarakami-gun (JP); Motohiko Sakamaki, Ashigarakami-gun (JP); Takeshi Matsunaga, Ashigarakami-gun (JP); Kiyoshi Shigehiro, Ashigarakami-gun (JP)

(73) Assignee: Fuji Xerox Co., Ltd., Tokyo (JP)

( * ) Notice: Subject to any disclaimer, the term of this patent is extended or adjusted under 35 U.S.C. 154(b) by 496 days.

(21) Appl. No.: 10/730,924

(22) Filed: Dec. 10, 2003

(65) Prior Publication Data

US 2004/0239666 A1 Dec. 2, 2004

(30) Foreign Application Priority Data

May 28, 2003 (JP) ..... 2003-150133

(51) Int. Cl.
*G09G 3/36* (2006.01)

(52) U.S. Cl. ..... 345/103; 345/209

(58) Field of Classification Search ..... 345/87, 345/103, 204, 211, 96, 209, 214
See application file for complete search history.

(56) References Cited

U.S. PATENT DOCUMENTS 6,262,696 B1 * 7/2001 Seraphim et al. ..... 345/1.3
6,285,424 B1 * 9/2001 Yoshida ..... 349/110
2003/0075733 A1 * 4/2003 Yamazaki et al. ..... 257/200
2005/0270456 A1 * 12/2005 Iijima ..... 349/114

FOREIGN PATENT DOCUMENTS

| | | |
|---|---|---|
| JP | A 11-133375 | 5/1999 |
| JP | A 2001-66623 | 3/2001 |
| JP | A 2001-242436 | 9/2001 |
| JP | A 2002-139747 | 5/2002 |

* cited by examiner

*Primary Examiner*—Ricardo Osorio
(74) *Attorney, Agent, or Firm*—Oliff & Berridge, PLC

(57) ABSTRACT

In an image display device of the present invention, a display substrate has m row electrodes, and a back surface substrate has n column electrodes. The display substrate and the back surface substrate are disposed so as to face one another and such that the electrodes thereof are orthogonal to one another (a simple matrix structure). A top-plane side driving portion is structured by a row electrode driving circuit, a reversing portion, and a reversing switch. When the reversing switch is on, the reversing portion reverses relationships of connection between the row electrode driving circuit and the row electrodes. The backplane side driving portion is structured by a column electrode driving circuit, a reversing portion, and a reversing switch. When the reversing switch is on, the reversing portion reverses relationships of connection between the column electrode driving circuit and the column electrodes. In accordance with the image display device, when a large screen is formed by using a plurality of same image display media, images can be displayed normally at all of the image display media.

20 Claims, 14 Drawing Sheets

IMAGE DISPLAY DEVICE

CROSS-REFERENCE TO RELATED APPLICATION

This application claims priority under 35 USC 119 from Japanese Patent Application No. 2003-150133, the disclosures of which are incorporated by reference herein.

BACKGROUND OF THE INVENTION

1. Field of the Invention

The present invention relates to an image display device, and in particular, to an image display device having an image display means at which a plurality of image display media are arranged side-by-side.

2. Description of the Related Art

Liquid crystal display devices, which display images by simple matrix driving, have conventionally been known (refer to, for example, Patent Documents 1 through 3). The substrate of a simple matrix driving type image display medium is structured, for example, such that a display substrate 12, at which a plurality of linear row electrodes $\mathbf{16}_1$–$\mathbf{16}_m$ as shown in FIG. 10A are provided, and a back surface substrate 14, at which a plurality of linear column electrodes $\mathbf{18}_1$–$\mathbf{18}_n$ as shown in FIG. 10B are provided, are disposed so as to face one another and such that the row electrodes $\mathbf{16}_1$–$\mathbf{16}_m$ and the column electrodes $\mathbf{18}_1$–$\mathbf{18}_n$ are orthogonal to one another as shown in FIG. 11. The row electrodes $\mathbf{16}_1$–$\mathbf{16}_m$ are driven by a row electrode driving circuit 32, and the column electrodes $\mathbf{18}_1$–$\mathbf{18}_n$ are driven by a column electrode driving circuit 44.

When an image is displayed on an image display medium having such a simple matrix structure, a predetermined voltage is successively applied to the row electrodes $\mathbf{16}_1$–$\mathbf{16}_m$, and synchronously therewith, a predetermined voltage is applied to the column electrodes 18 corresponding to the line image of the row-line to which voltage is applied, such that the image is displayed line-by-line.

Moreover, a technique is known in which a plurality of these image display media are arranged side-by-side, so as to create a large screen (see, for example, Patent Documents 1, 2, 4). When forming a large screen by arranging a plurality of image display media side-by-side, utilizing a plurality of the same image display media is effective in terms of costs. For example, in the case of forming a large screen of two rows and two columns by using four image display media 10 as shown in FIG. 12, four display substrate portions 40, each of which is formed from the row electrode driving circuit 32 and the display substrate 12 shown in FIG. 10A, and four back surface substrate portions 52, each of which is formed from the column electrode driving circuit 44 and the back surface substrate 14 shown in FIG. 10B, are used, and are disposed such that all of the wires from the electrodes are led-out from the outer edge portion as shown in FIG. 12. Moreover, as shown in FIG. 13, the respective row electrode driving circuits 32A~32D and column electrode driving circuits 44A–44D are controlled by a control section 62.

However, the following problem arises when forming a large screen by using the same display substrate portions 40 and back surface substrate portions 52 as described above. Namely, because the order of driving the electrodes at the display substrate portions 40 and back surface substrate portions 52 is determined in advance, as shown in FIG. 12, when the image display medium 10A is used as a reference, the order of the row electrodes $\mathbf{16}_1$–$\mathbf{16}_m$ at the image display medium 10B is reversed, the order of the column electrodes $\mathbf{18}_1$–$\mathbf{18}_n$ at the image display medium 10C is reversed, and the orders of both the row electrodes $\mathbf{16}_1$–$\mathbf{16}_m$ and the column electrodes $\mathbf{18}_1$–$\mathbf{18}_n$ at the image display medium 10D are reversed.

Accordingly, the problem arises that, as shown in FIG. 14 for example, when a Japanese character is displayed on each of the image display media 10A–10D, although the character is displayed normally at the image display medium 10A, the character is displayed upside down in terms of row order at the image display medium 10B, and is displayed with the left and right sides thereof reversed in terms of column order at the image display medium 10C, and is displayed upside down in terms of row order and with the left and right sides thereof reversed in terms of column order at the image display medium 10D.

Patent Document 1

Japanese Patent Application Laid-Open (JP-A) No. 11-133375

Patent Document 2

Japanese Patent Application Laid-Open (JP-A) No. 2001-242436

Patent Document 3

Japanese Patent Application Laid-Open (JP-A) No. 2001-66623

Patent Document 4

Japanese Patent Application Laid-Open (JP-A) No. 2002-139747

SUMMARY OF THE INVENTION

The present invention has been developed in order to overcome the above-described problem, and an object thereof is to provide an image display device which, when forming a large screen by using a plurality of the same image display media, can display images normally.

In order to achieve the above-described object, a first aspect of the present invention is an image display device comprising: (A) image display means at which a plurality of image display media are arranged side-by-side, the image display means including: (i) a display substrate portion having a display substrate at which a plurality of top-plane side electrodes are formed, and a top-plane side voltage applying means for applying voltage to the top-plane side electrodes; (ii) a back surface substrate portion having a back surface substrate at which a plurality of backplane side electrodes are formed, and a backplane side voltage applying means for applying voltage to the backplane side electrodes; and (iii) display bodies sealed between the display substrate and the back surface substrate; (B) control means for controlling the top-plane side voltage applying means and the backplane side voltage applying means of the plurality of image display media on the basis of image data; and (C) reference pixel position adjusting means for adjusting reference pixel positions such that the reference pixel positions match at the plurality of image display media, each of the reference pixel positions being determined by a reference top-plane side electrode, which is determined in advance from among the plurality of top-plane side electrodes, and a reference backplane side electrode, which is determined in advance from among the plurality of backplane side electrodes.

In accordance with the first aspect, the image display means has a structure in which a large screen is formed by arranging a plurality of the same image display media side-by-side. For example, as in a fifth aspect which will be described later, the image display means may be structured such that four of the image display media are arranged in two rows and two columns.

Or, as in a sixth aspect which will be described later, the plurality of top-plane side electrodes and the plurality of backplane side electrodes may be a simple matrix structure.

In the case of such a structure, it is preferable that all of the wires from the top-plane side electrodes and the backplane side electrodes are led-out from the outer edge portion of the image display means. However, with such an arrangement, the up/down, left/right orientations of the respective image display media differ, such that the orientations of the images are not normal.

Thus, the reference pixel position adjusting means carries out adjustment such that the reference pixel positions respectively match (i.e., are the same position) at the plurality of image display media. The reference pixel position is a position which is determined by a reference top-plane side electrode, which is determined in advance from among the plurality of top-plane side electrodes, and a reference backplane side electrode, which is determined in advance from among the plurality of backplane side electrodes. For example, the position in the upper left corner of the screen can be the reference pixel position.

In this way, due to the reference pixel positions being adjusted so as to respectively match at the plural image display media, the orientations of the images are all the same, and the images can be displayed normally.

Specifically, in a second aspect of the present invention, the reference pixel position adjusting means has: a plurality of top-plane side reversing means provided respectively at a plurality of the display substrate portions, and reversing wiring connections between the plurality of top-plane side electrodes and the top-plane side voltage applying means; a plurality of top-plane side reversal switching switches provided in correspondence with the plurality of top-plane side reversing means respectively, for turning a reversal operation by the top-plane side reversing means on and off; a plurality of backplane side reversing means provided respectively at a plurality of the back surface substrate portions, and reversing wiring connections between the plurality of backplane side electrodes and the backplane side voltage applying means; and a plurality of backplane side reversal switching switches provided in correspondence with the plurality of backplane side reversing means respectively, for turning a reversal operation by the backplane side reversing means on and off.

In accordance with the second aspect, at each of the image display media, the wiring connections between the plural top-plane side electrodes and the top-plane side voltage applying means can be reversed due to the top-plane side reversal switching switch being on, and the wiring connections between the plural backplane side electrodes and the backplane side voltage applying means can be reversed due to the backplane side reversal switching switch being on.

Accordingly, by turning the top-plane side reversal switching switch and the backplane side reversal switching switch on appropriately on the basis of the arrangement of the image display media, the reference pixel positions of all of the image display media can be made to match.

In a third aspect of the present invention, the reference pixel position adjusting means can be structured to have an image data reversing means which reverses the image data on the basis of an arrangement of the plurality of image display media.

In accordance with the third aspect, the reference pixel positions of all of the image display media are made to match by reversing the image data. Therefore, the reversing means can be omitted.

In a fourth aspect of the present invention, the image display device further comprises position detecting means for detecting placed positions of the image display media, wherein, on the basis of the placed positions detected by the position detecting means, the reference pixel position adjusting means carries out adjustment such that the reference pixel positions match at the plurality of image display media.

In accordance with the fourth aspect, the placed positions of the image display media are automatically detected by the position detecting means. On the basis of the detected placed positions, the reference pixel positions of the plural image display media are made to match. Therefore, on/off operation of a reversal switching switch can be eliminated, and the convenience of the device can be improved.

DETAILED DESCRIPTION OF THE INVENTION

Figure 1A:
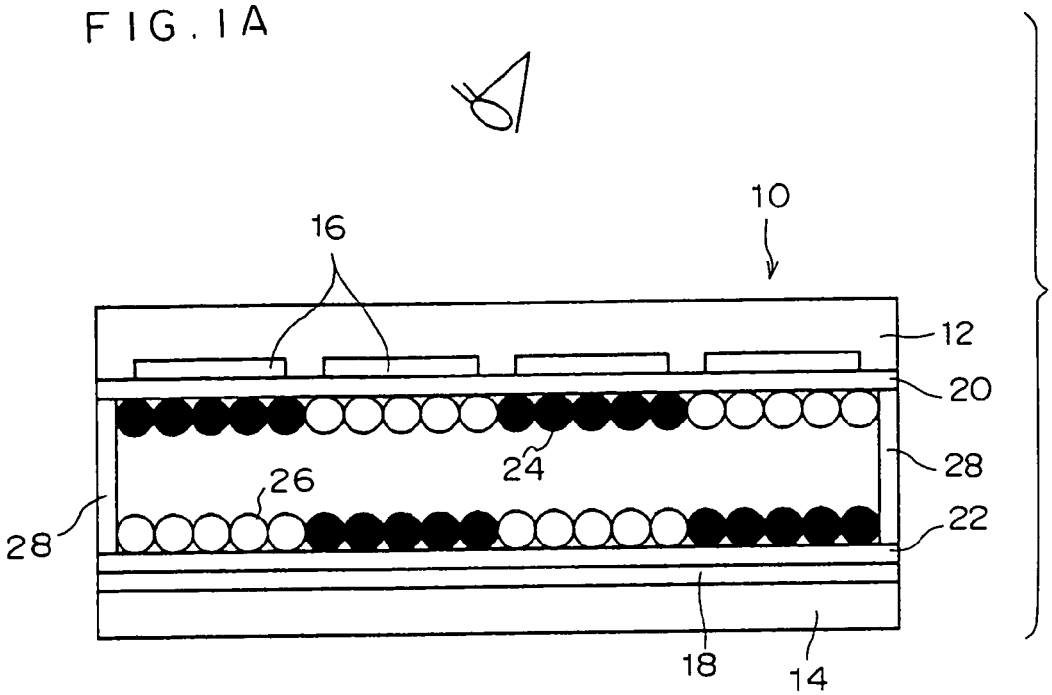
FIGS. 1A and 1B are sectional views of an image display medium relating to a first embodiment.

Hereinafter, embodiments of the present invention will be described in detail with reference to the drawings.

(First Embodiment)

The present embodiment is a structure in which the present invention is applied to an image display device which displays images on a plurality of image display media by simple matrix driving. Note that portions which are the same as those described in the above description of the related art are denoted by the same reference numerals.

Figure 1B:
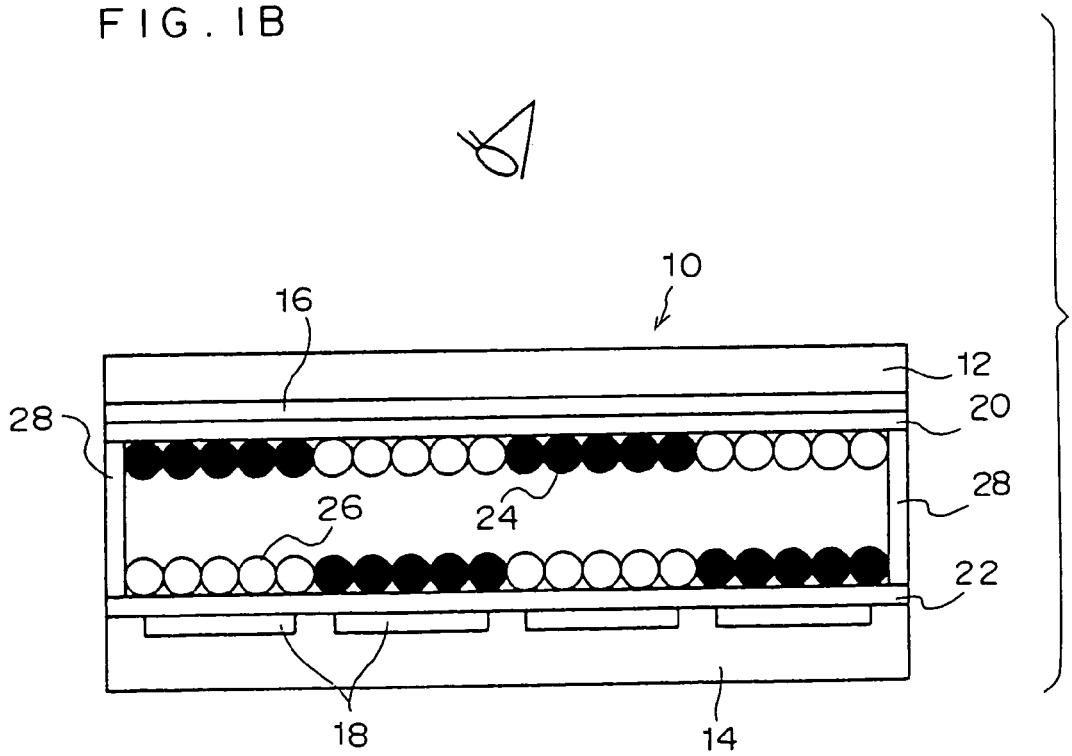

Sectional views of the image display medium 10 relating to the present embodiment are shown in FIGS. 1A and 1B. As shown in FIGS. 1A and 1B, the image display medium 10 has the display substrate 12 which is transparent and is at the image top-plane side, and the back surface substrate 14 which is disposed so as to oppose the display substrate 12 and so as to be separated therefrom by a predetermined interval. The image display medium 10 is driven in accordance with a so-called simple matrix driving method.

As shown in FIGS. 1A and 1B, the plurality of linear row electrodes 16 are provided at the surface of the display substrate 12 which surface opposes the back surface substrate 14. Similarly, the plurality of the linear column electrodes 18 are provided at the surface of the back surface substrate 14 which surface opposes the display substrate 12. The display substrate 12 and the back surface substrate 14 are disposed so as to face one another such that the row electrodes 16 and the column electrodes 18 provided there at are orthogonal to one another. The positions where the row electrodes 16 and the column electrodes 18 intersect form pixels. Note that FIG. 1A is a sectional view of the image display medium 10 along the column electrodes 18, and FIG. 1B is a sectional view of the image display medium 10 along the row electrodes 16.

An insulating layer 20 is formed at the row electrode 16 side, and an insulating layer 22 is formed at the column electrode 18 side. The insulating layers 20, 22 are formed of, for example, polycarbonate or the like.

In the present embodiment, the linear electrodes of the display substrate 12 are the row electrodes, and the linear electrodes of the back surface substrate 14 form the column electrodes. However, conversely, the column electrodes may be provided at the display substrate 12, and the row electrodes may be provided at the back surface substrate 14.

Black particles 24, which are charged positive, and white particles 26, which are charged negative, are filled between the display substrate 12 and the back surface substrate 14. The black particles 24 and the white particles 26 are particle groups having different charge characteristics. Further, gap members 28 are provided between the display substrate 12 and the back surface substrate 14. The space between the display substrate 12 and the back surface substrate 14 is thereby held at a constant interval.

When voltage, which is a predetermined voltage or more and which is for causing the particles to move between the substrates, is applied, the black particles 24 and the white particles 26 move between the substrates. Namely, when a predetermined positive voltage is applied between the column electrodes 18 and the row electrodes 16 with the column electrodes 18 being the reference (neutral), the black particles 24 at the display substrate 12 side move toward the back surface substrate 14 side, and the white particles 26 at the back surface substrate 14 side move toward the display substrate 12 side. On the other hand, when a predetermined negative voltage is applied between the column electrodes 18 and the row electrodes 16 with the column electrodes 18 being the reference (neutral), the white particles 26 at the display substrate 12 side move toward the back surface substrate 14 side, and the black particles 24 at the back surface substrate 14 side move toward the display substrate 12 side.

In the image display medium 10, a predetermined voltage is applied (scanned) successively to the row electrodes 16, and synchronously therewith, a predetermined voltage is successively applied to the column electrodes 18 corresponding to the line image of the row to which voltage is applied. In this way, the particles at the positions where voltage which is a predetermined voltage or more has been applied between the row electrode 16 and the column electrodes 18 move between the substrates, and an image is formed. In this simple matrix driving, the entire image is displayed by the line images being successively displayed and scanning being carried out until the final line.

Figure 2A:
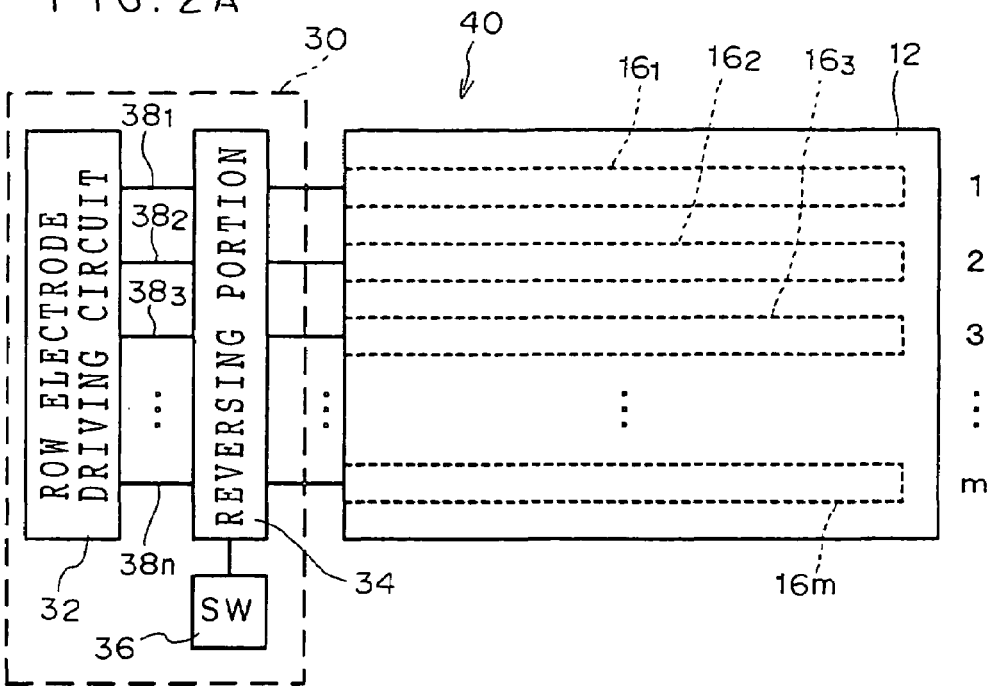
FIG. 2A is a schematic structural view of a display substrate portion relating to the first embodiment.
Figure 2B:
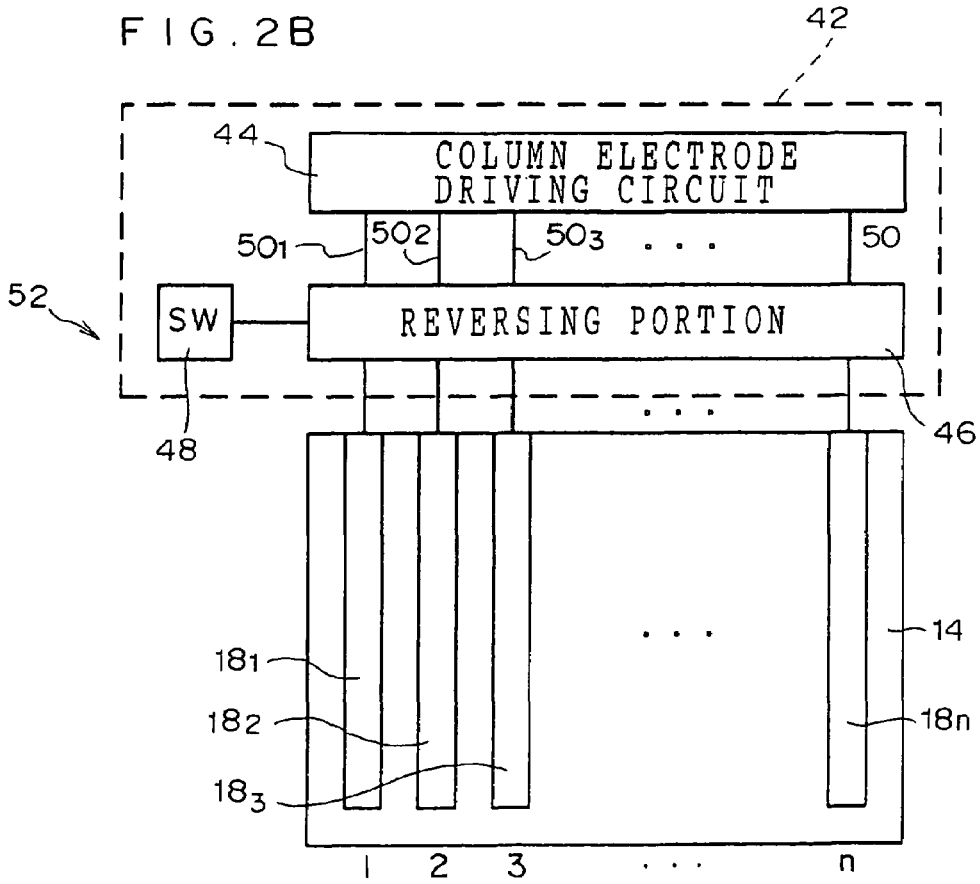
FIG. 2B is a schematic structural view of a back surface substrate portion relating to the first embodiment.

Note that, in FIGS. 1A and 1B, a 4×4 simple matrix structure is illustrated in order to simplify explanation. However, in actuality, as shown in FIG. 2A, the display substrate 12 is provided with the m row electrodes $\mathbf{16}_1$–$\mathbf{16}_m$, and as shown in FIG. 2B, the back surface substrate 14 is provided with the n column electrodes $\mathbf{18}_1$–$\mathbf{18}_n$, such that an m x n simple matrix structure is formed.

The row electrodes $\mathbf{16}_1$–$\mathbf{16}_m$ are driven by a top-plane side driving portion 30. The top-plane side driving portion 30 is structured by the row electrode driving circuit 32, a reversing portion 34, and a reversing switch 36. The row electrode driving circuit 32 is connected to an unillustrated power source, and applies a predetermined voltage to the row electrodes $\mathbf{16}_1$–$\mathbf{16}_m$ in accordance with an instruction from a control section which is not illustrated.

When the reversing switch 36 is on, the reversing portion 34 reverses the relationships of connection between the row electrode driving circuit 32 and the row electrodes $\mathbf{16}_1$–$\mathbf{16}_m$. Specifically, when the reversing switch 36 is off, wires $\mathbf{38}_1$~$\mathbf{38}_m$, which connect the row electrode driving circuit 32 and the reversing portion 34, are connected to the row electrodes $\mathbf{16}_1$–$\mathbf{16}_m$ respectively. However, when the reversing switch 36 is on, the state of connection is changed such that the wires $\mathbf{38}_1$~$\mathbf{38}_m$ are connected to the row electrodes $\mathbf{16}_m$–$\mathbf{16}_1$ respectively. Namely, the wire $\mathbf{38}_1$ is connected to the row electrode $\mathbf{16}_m$, the wire $\mathbf{38}_2$ is connected to the row electrode $\mathbf{16}_{m-1}$, . . . the wire $\mathbf{38}_{m-1}$ is connected to the row electrode $\mathbf{16}_2$, and the wire $\mathbf{38}_m$ is connected to the row electrode $\mathbf{16}_1$.

The reversing switch 36 is structured, for example, by a dip switch or the like so as to be easily operated by, for example, the person who sets up the image display medium 10. Note that the display substrate portion 40 is structured by the top-plane side driving portion 30 and the display substrate 12.

The column electrodes $\mathbf{18}_1$–$\mathbf{18}_n$ are driven by a backplane side driving portion 42. The backplane side driving portion 42 is structured by the column electrode driving circuit 44, a reversing portion 46, and a reversing switch 48. The column electrode driving circuit 44 is connected to an unillustrated power source, and applies a predetermined voltage to the column electrodes $\mathbf{18}_1$–$\mathbf{18}_n$ in accordance with an instruction from a control section which is not illustrated.

When the reversing switch 48 is on, the reversing portion 46 reverses the relationships of connection between the column electrode driving circuit 44 and the column electrodes $\mathbf{18}_1$–$\mathbf{18}_n$. Specifically, when the reversing switch 48 is off, wires $\mathbf{50}_1$~$\mathbf{50}_n$, which connect the column electrode driving circuit 44 and the reversing portion 46, are connected to the column electrodes $\mathbf{18}_1$–$\mathbf{18}_n$ respectively. However, when the reversing switch 48 is on, the state of connection is changed such that the wires $\mathbf{50}_1$~$\mathbf{50}_n$ are connected to the column electrodes $\mathbf{18}_n$–$\mathbf{18}_1$ respectively. Namely, the wire $\mathbf{50}_1$ is connected to the column electrode $\mathbf{18}_n$, the wire $\mathbf{50}_2$ is connected to the column electrode $\mathbf{18}_{n-1}$, . . . the wire $\mathbf{50}_{n-1}$ is connected to the column electrode $\mathbf{18}_2$, and the wire $\mathbf{50}_n$ is connected to the column electrode $\mathbf{18}_1$.

Note that the back surface substrate portion 52 is structured by the backplane side driving portion 42 and the back surface substrate 14.

Figure 3:
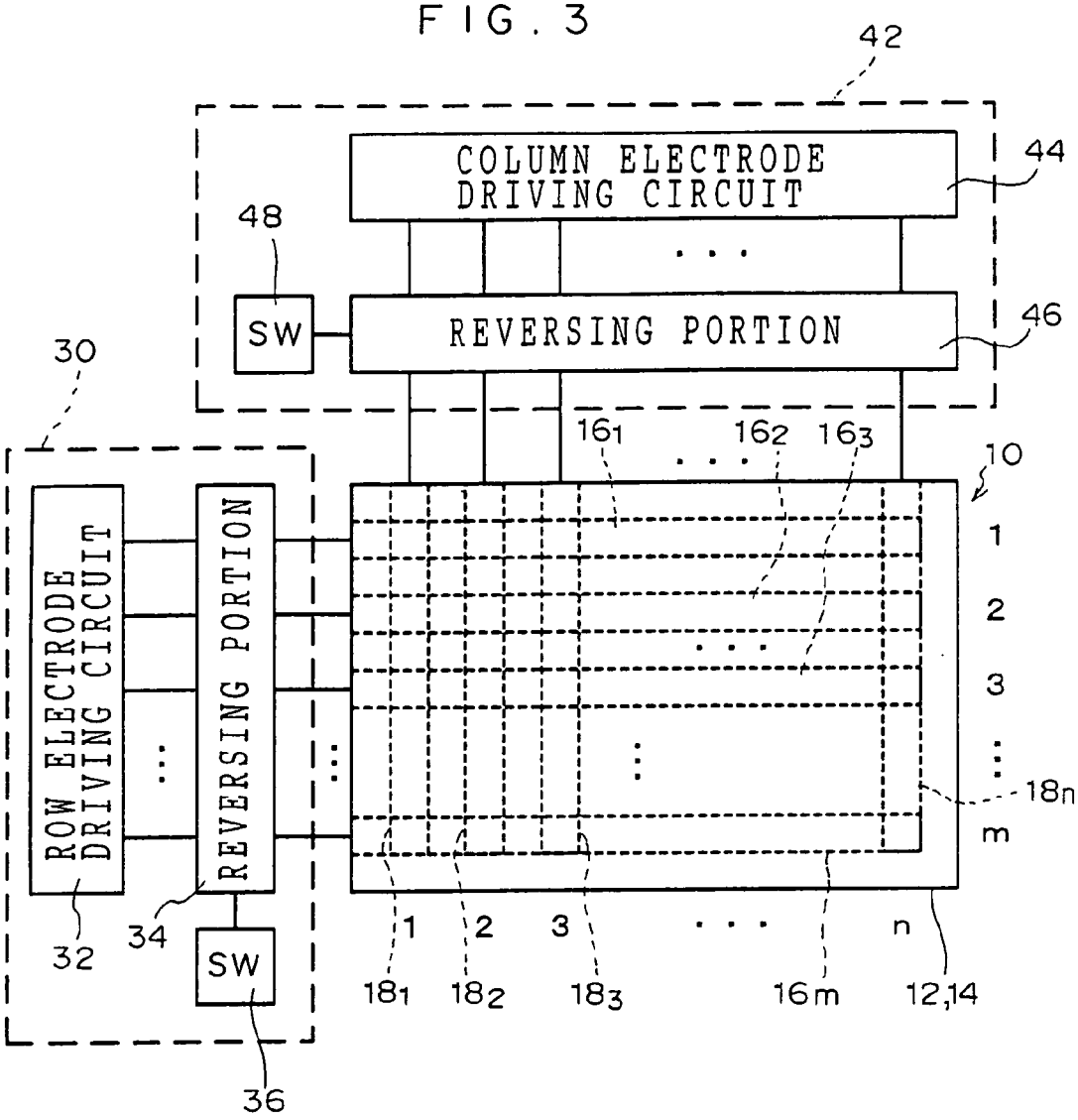
FIG. 3 is a diagram at the time when a display substrate and a back surface substrate relating to the first embodiment are superposed together.

As shown in FIG. 3, due to the row electrodes $\mathbf{16}_1$–$\mathbf{16}_m$ and the column electrodes $\mathbf{18}_1$–$\mathbf{18}_n$ being disposed so as to face one another and so as to be orthogonal to one another, an m×n simple matrix structure is formed. Note that, in the following description, the coordinates of the pixels will be expressed as (line number, column number). Namely, for example, the coordinate of the position where the row electrode $\mathbf{16}_1$ and the column electrode $\mathbf{18}_1$ intersect one another is (1, 1), and the coordinate of the position where the row electrode $\mathbf{16}_m$ and the column electrode $\mathbf{18}_n$ intersect one another is (m, n).

A large screen can be formed by utilizing a plurality of the display substrate portions 40 and the back surface substrate portions 52 illustrated in FIGS. 2A and 2B. An image display device 60, in which four of the image display media 10A–10D are arranged side-by-side in two lines and two columns, is shown in FIG. 4.

Figure 4:
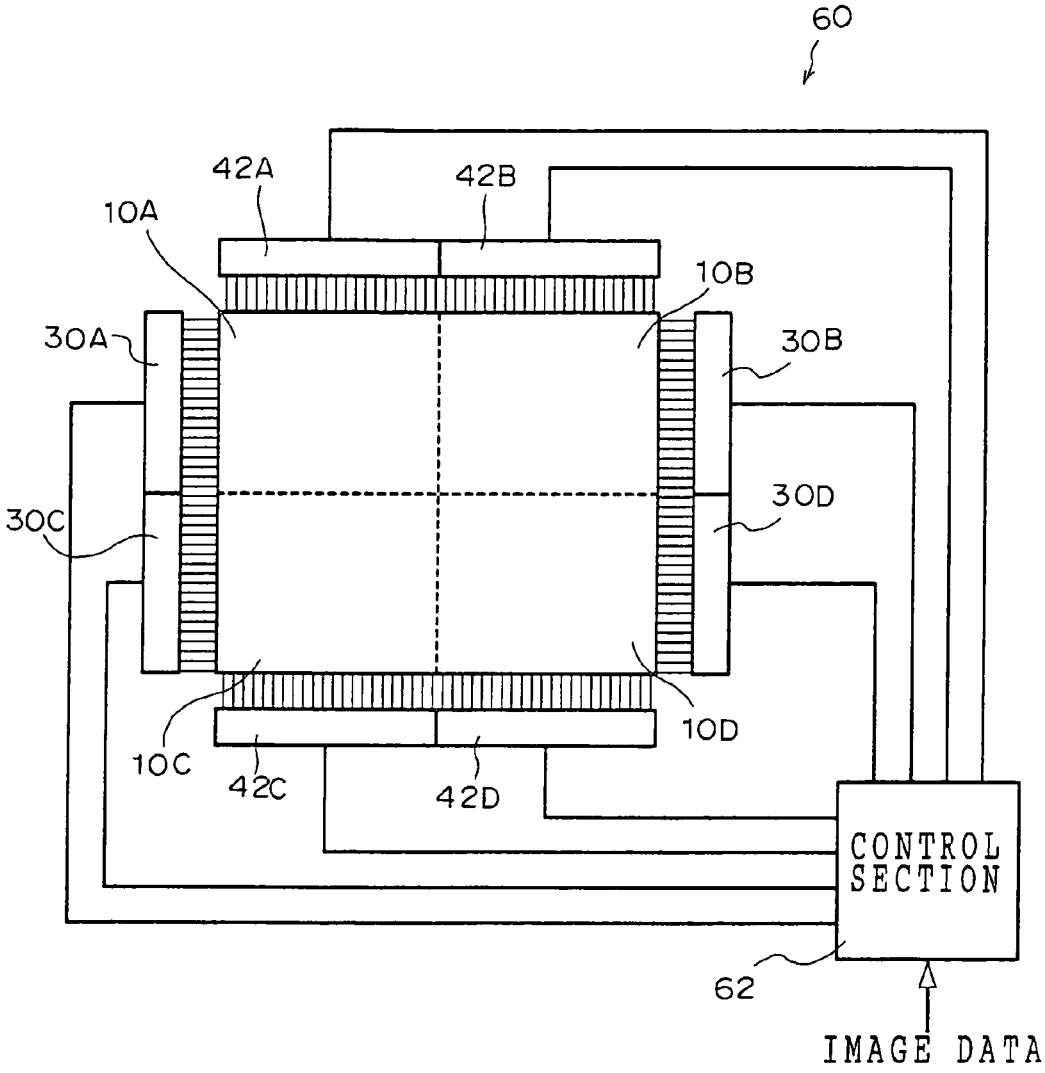
FIG. 4 is a schematic structural view of an image display device relating to the first embodiment.

As shown in FIG. 4, the image display device 60 has the control section 62. The control section 62 is connected to the row electrode driving circuits 32 of the four top-plane side driving portions 30A–30D, and is connected to the column electrode driving circuits 44 of the backplane side driving portions 42A~42D.

On the basis of inputted image data, the control section 62 controls, by the above-described simple matrix driving, the row electrode driving circuit 32 of the top-plane side driving portion 30A and the column electrode driving circuit 44 of the backplane side driving portion 42A, the row electrode driving circuit 32 of the top-plane side driving portion 30B and the column electrode driving circuit 44 of the backplane side driving portion 42B, the row electrode driving circuit 32 of the top-plane side driving portion 30C and the column electrode driving circuit 44 of the backplane side driving portion 42C, and the row electrode driving circuit 32 of the top-plane side driving portion 30D and the column electrode driving circuit 44 of the backplane side driving portion 42D.

Note that, when an image is displayed by using all of the image display media 10A–10D as a single screen, the control section 62 generates image data of divisional images obtained by dividing the image to be displayed into four, and respectively controls the row electrode driving circuits 32 of the top-plane side driving portions 30A–30D and the column electrode driving circuits 44 of the backplane side driving portions 42A~42D on the basis of the generated image data.

In this way, by using the same display substrate portions 40 and back surface substrate portions 52, a large screen can be formed inexpensively. However, as shown in the previously described FIG. 12, the order of the row electrodes $\mathbf{16}_1$–$\mathbf{16}_m$ at the image display medium 10B is reversed, the order of the column electrodes $\mathbf{18}_1$–$\mathbf{18}_n$ at the image display medium 10C is reversed, and the orders of the row electrodes $\mathbf{16}_1$–$\mathbf{16}_m$ and the column electrodes $\mathbf{18}_1$–$\mathbf{18}_n$ at the image display medium 10D are reversed.

Figure 14:
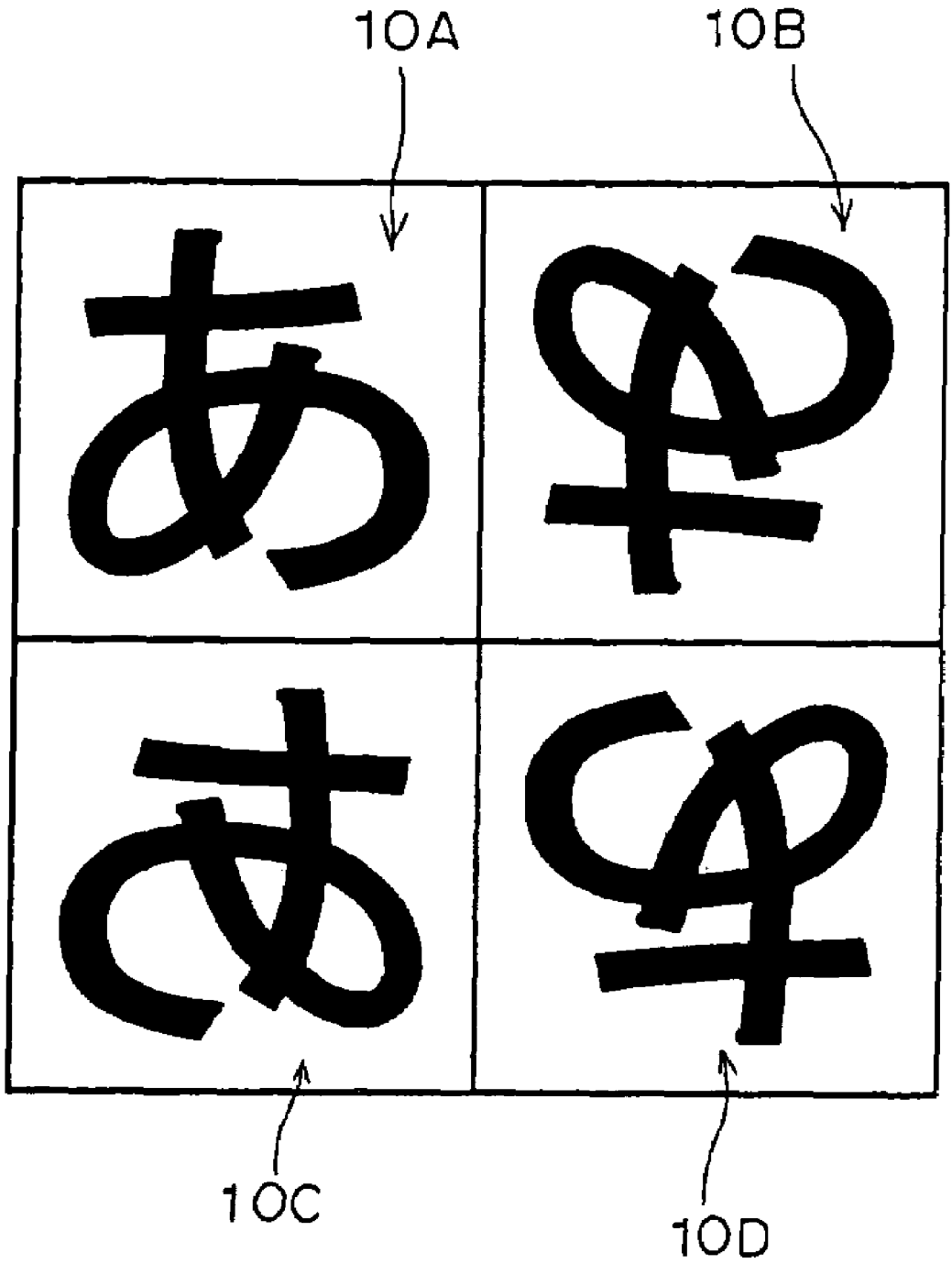
FIG. 14 is an image diagram showing a display example in accordance with the image display device relating to the conventional example.

Namely, when the reference pixel position is (1, 1), the position of the pixel at the upper left corner of the image display medium 10A is reference pixel position 64A, the position of the pixel at the lower left corner of the image display medium 10B is reference pixel position 64B, the position of the pixel at the upper right corner of the image display medium 10C is reference pixel position 64C, and the position of the pixel at the lower right corner of the image display medium 10D is reference pixel position 64D. Accordingly, as shown in FIG. 14, when a Japanese character is displayed in the respective image display media 10A–10D, in the manner described above, the orientations of the respective characters do not match, and the image cannot be displayed normally.

In such a case, the reversing switch 36 of the top-plane side driving portion 30B corresponding to the image display medium 10B is turned on, the reversing switch 48 of the backplane side driving portion 42C corresponding to the image display medium 10C is turned on, and the reversing switch 36 of the top-plane side driving portion 30D and the reversing switch 48 of the backplane side driving portion 42D corresponding to the image display medium 10D are turned on. This operation of the reversing switches is carried out by, for example, the person who sets up the image display device or the like.

In this way, the relationships of connection between the row electrode driving circuit 32 and the row electrodes $\mathbf{16}_1$–$\mathbf{16}_m$ of the image display medium 10B are reversed, the relationships of connection between the column electrode driving circuit 44 and the column electrodes $\mathbf{18}_1$–$\mathbf{18}_n$ of the image display medium 10C are reversed, and the relationships of connection between the row electrode driving circuit 32 and the row electrodes $\mathbf{16}_1$–$\mathbf{16}_m$ and the relationships of connection between the column electrode driving circuit 44 and the column electrodes $\mathbf{18}_1$–$\mathbf{18}_n$ of the image display medium 10D, are reversed.

Figure 5:
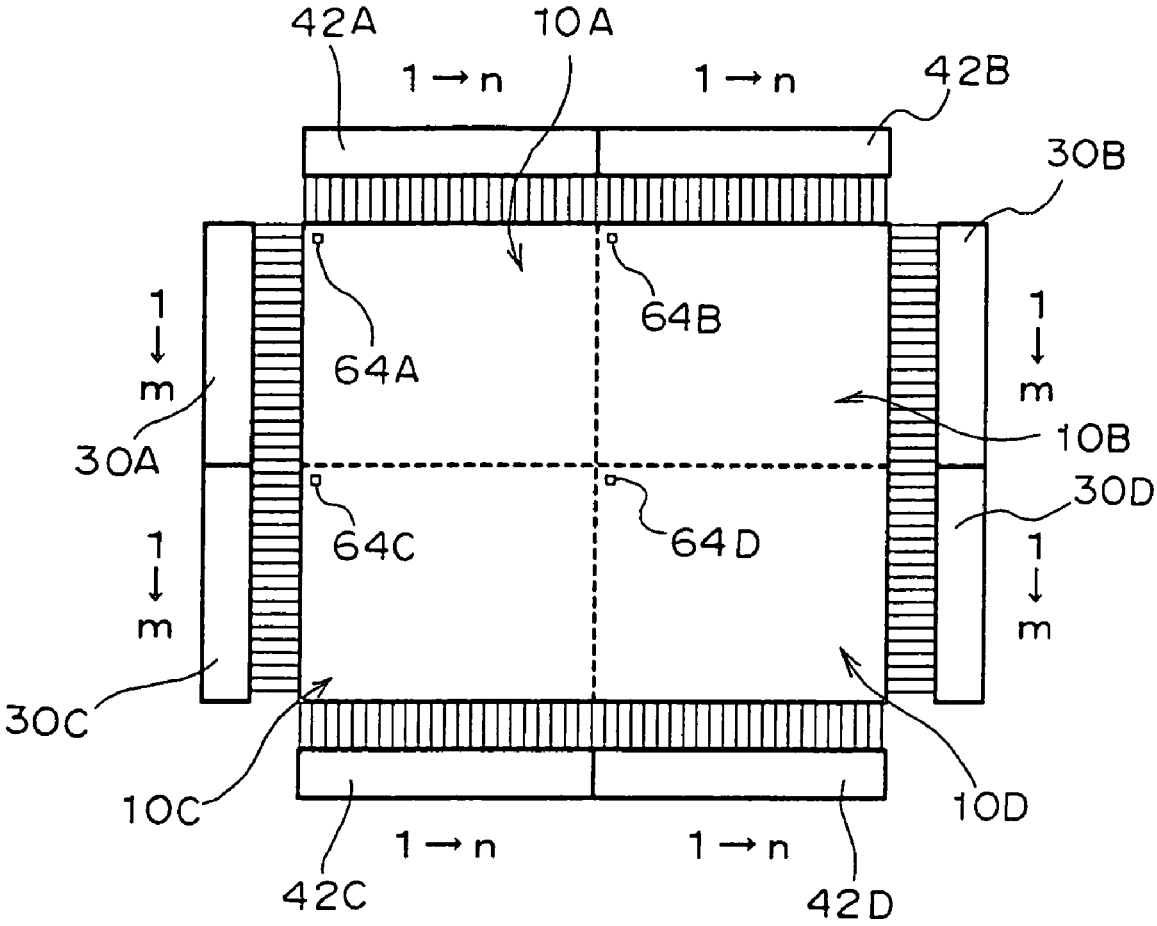
FIG. 5 is a diagram for explaining a reference pixel position relating to the first embodiment.
Figure 6:
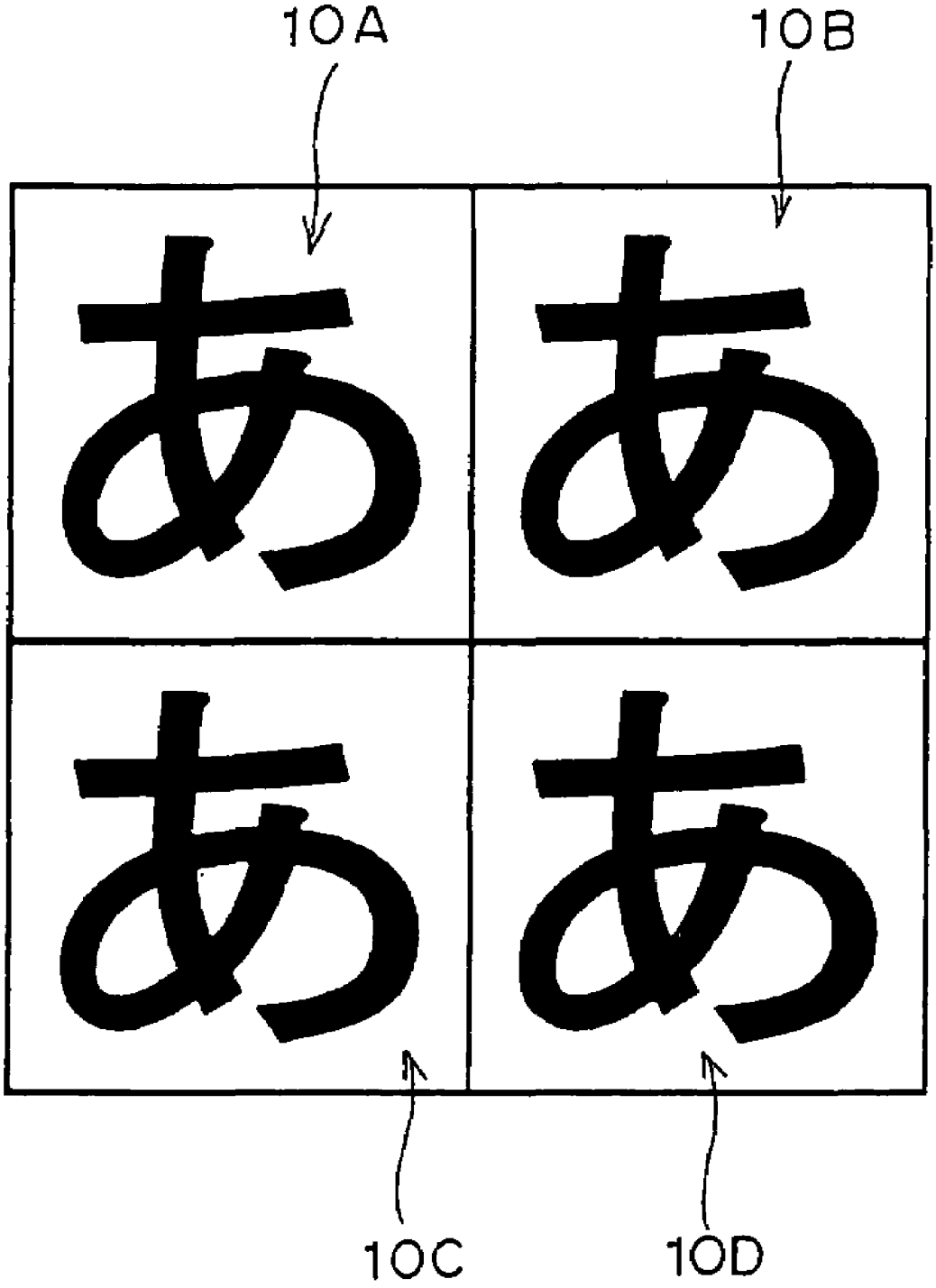
FIG. 6 is an image diagram showing a display example in accordance with the image display device relating to the first embodiment.

Accordingly, as shown in FIG. 5, all of the reference pixel positions 64A–64D of the image display media 10A–10D become the positions of the pixels at the top left corners. In this way, as shown in FIG. 6 for example, when a Japanese character is displayed in each of the image display media 10A–10D, it is displayed normally in all of the image display media 10A~10D.

In this way, in the present embodiment, the reversing portion 34, which is for reversing the relationships of connection between the row electrode driving circuit 32 and the row electrodes $\mathbf{16}_1$–$\mathbf{16}_m$ of the image display medium 10, is provided at the top-plane side driving portion 30. Further, the reversing portion 46, which is for reversing the relationships of connection between the column electrode driving circuit 44 and the column electrodes $\mathbf{18}_1$–$\mathbf{18}_n$, is provided at the backplane side driving portion 42. The reversing portion 34 and the reversing portion 46 can be easily made to reverse the relationships of connection by the reversing switches 36, 48. In this way, because the reference pixel positions can all be made to match, images can be displayed normally even when a large screen is formed by using a plurality of the same image display media.

Note that, in the present embodiment, description is given of a case in which a large screen is created by combining four of the display substrate portions 40 and four of the back surface substrate portions 52. In this case, as shown in FIG. 4, when the display substrate portion 40 and the back surface substrate portion 52 of the image display medium 10A are rotated as are by 180°, they become the same as the display substrate portion 40 and the back surface substrate portion 52 of the image display medium 10D. Moreover, when the display substrate portion 40 and the back surface substrate portion 52 of the image display medium 10B are rotated as are by 180°, they become the same as the display substrate portion 40 and the back surface substrate portion 52 of the image display medium 10C.

Thus, the display substrate portion 40 and the back surface substrate portion 52 may be structured so as to be integral in the present embodiment. In this case, by disposing the top-plane side driving portion 30 and the backplane side driving portion 42 on the same substrate, the image display device 60 can be made to be more compact and can be made to be thinner.

(Second Embodiment)

Next, a second embodiment of the present invention will be described. In the present embodiment, description will be given of a case in which the reference pixel positions are made to match by automatically detecting the reference pixel positions of the respective image display media. Note that portions which are the same as those in the above-described embodiment are denoted by the same reference numerals, and detailed description thereof is omitted.

Figure 7A:
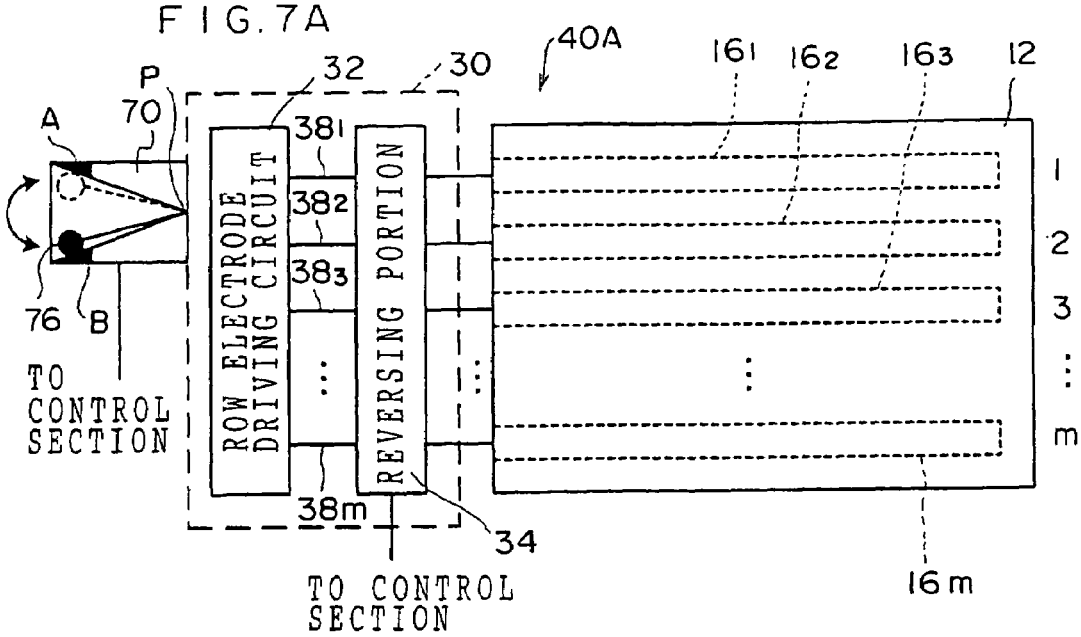
FIGS. 7A and 7B are sectional views of an image display medium relating to a second embodiment of the present invention.
Figure 7B:
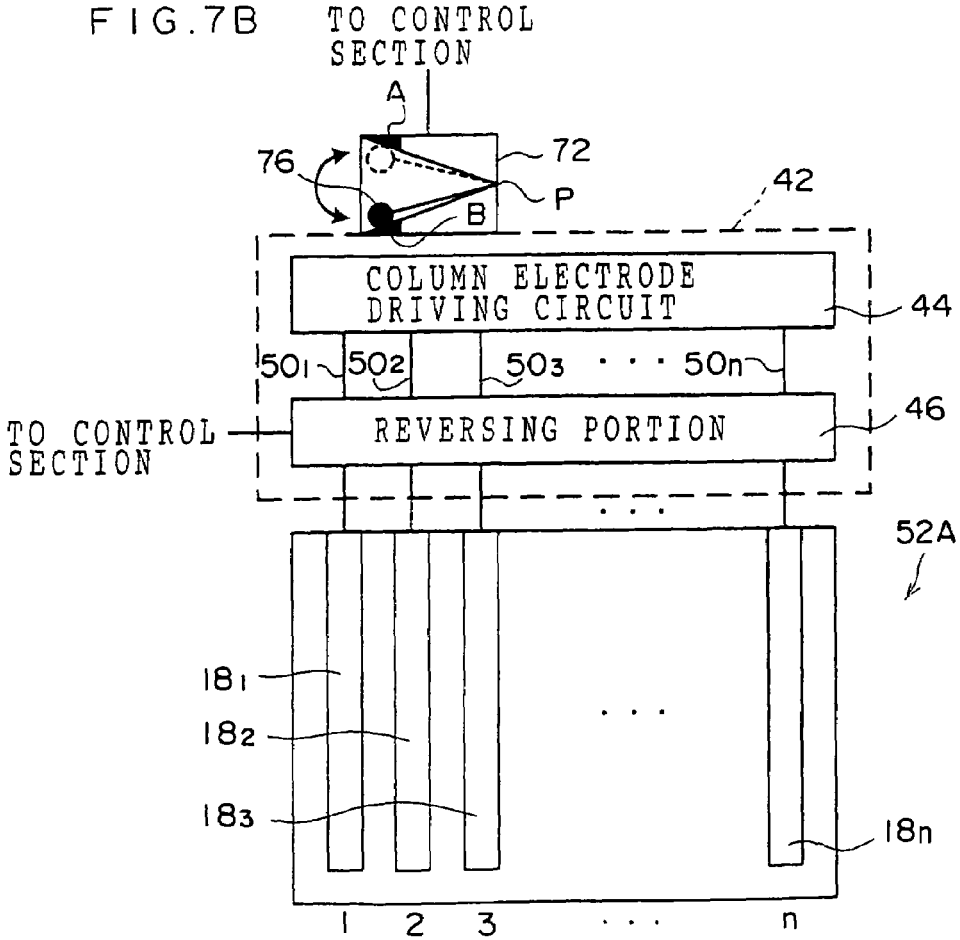

FIGS. 7A and 7B show the structures of a display substrate portion 40A and a back surface substrate portion 52A relating to the present embodiment.

The points of the display substrate portion 40A relating to FIG. 7A which differ from the display substrate portion 40 shown in FIG. 3 are that the reversing switch 36 is omitted, and that the reversing portion 34 is connected to the control section 62, and that a gravitational direction sensor 70 is provided. The reversing portion 34 reverses the relationships of connection between the row electrode driving circuit 32 and the row electrodes on the basis of a reversing signal from the control section 62. With regard to other points, the display substrate portion 40A is the same as the display substrate portion 40, and therefore, description of these other points will be omitted.

Moreover, the points of the back surface substrate portion 52A relating to FIG. 7B which differ from the back surface substrate portion 52 shown in FIG. 3 are that the reversing switch 48 is omitted, and that the reversing portion 46 is connected to the control section 62, and that a gravitational direction sensor 72 is provided. The reversing portion 46 reverses the relationships of connection between the column electrode driving circuit 44 and the column electrodes on the basis of a reversing signal from the control section 62. With regard to other points, the back surface substrate portion 52A is the same as the back surface substrate portion 52, and therefore, description of these other points will be omitted.

As shown in FIGS. 7A and 7B, the gravitational direction sensors 70, 72 each have a pendulum 76 at which a spherical, electrically-conductive member is provided at the distal end of a rod-shaped member. The gravitational direction sensor 70, 72 senses that the distal end of the pendulum 76 has contacted contact A or contact B, and outputs a sensing signal to the control section 62.

Figure 8:
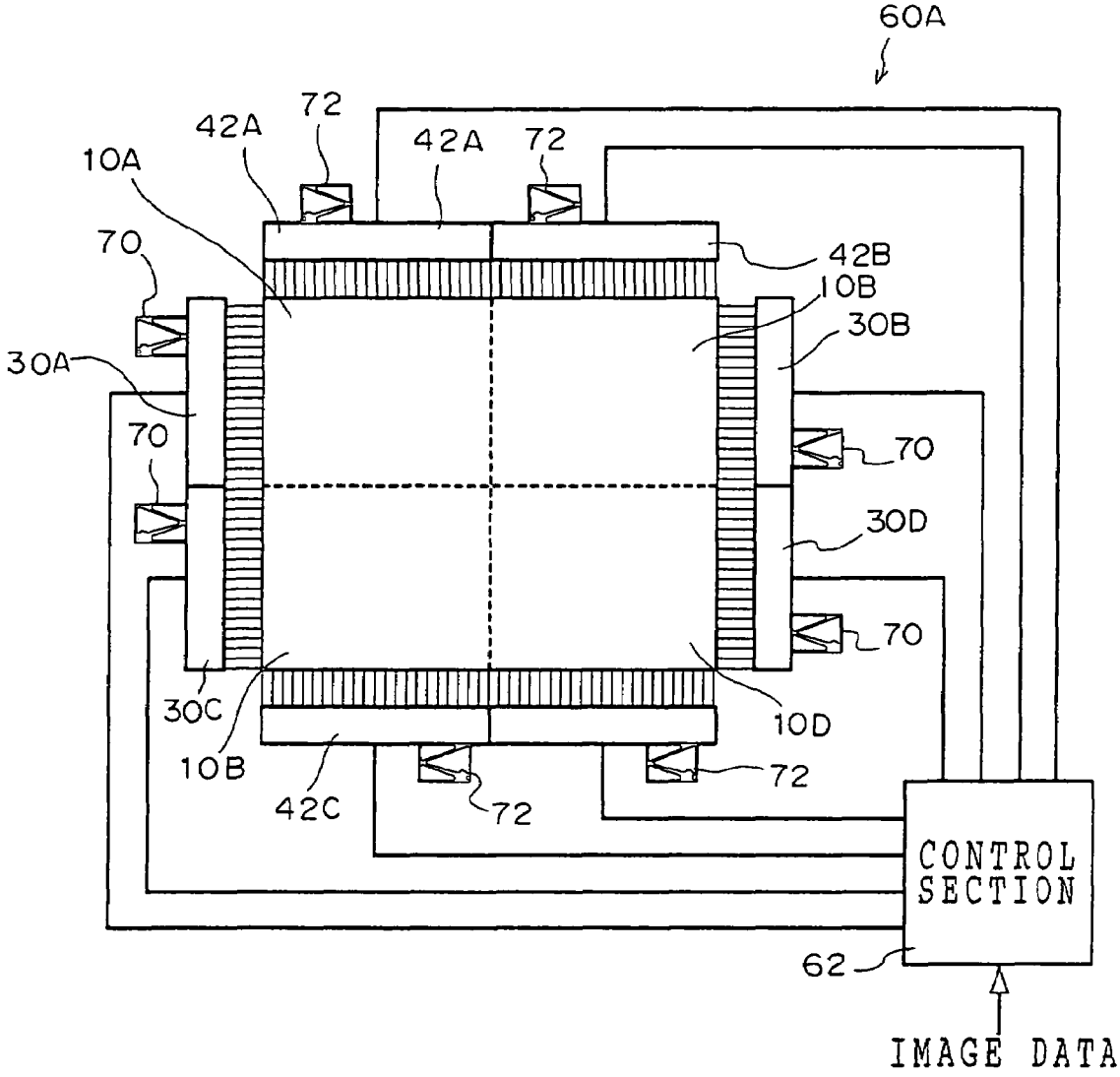
FIG. 8 is a schematic structural view of an image display device relating to the second embodiment.

The gravitational direction sensor 70 is provided, for example, on the substrate at which the top-plane side driving portion 30 is provided. The gravitational direction sensor 70 is mounted such that, when the display substrate portion 40 is disposed vertically, the pendulum 76 swings in the direction of gravity around the portion marked P as the fulcrum, in the drawing. Accordingly, when the distal end of the pendulum 76 contacts the contact A, as shown in FIG. 8, it can be recognized that the corresponding image display medium is positioned at the right side. When the distal end of the pendulum 76 contacts the contact B, as shown in FIG. 8, it can be recognized that the corresponding image display medium is positioned at the left side.

Similarly, the gravitational direction sensor 72 is provided, for example, on the substrate at which the backplane side driving portion 42 is provided. The gravitational direction sensor 72 is mounted such that, when the back surface substrate portion 52 is disposed vertically, the pendulum 76 swings in the direction of gravity around the portion marked P as the fulcrum, in the drawing. Accordingly, when the distal end of the pendulum 76 contacts the contact A, as shown in FIG. 8, it can be recognized that the corresponding image display medium is positioned at the lower side. When the distal end of the pendulum 76 contacts the contact B, as shown in FIG. 8, it can be recognized that the corresponding image display medium is positioned at the upper side.

On the basis of the sensing signals from the respective gravitational direction sensors 70, the control section 62 outputs reversing signals to the reversing portions 34 or the reversing portions 46. Specifically, when the control section 62 recognizes that the image display medium is positioned at the left side due to the sensing signal from the gravitational direction sensor 70 provided at the display substrate portion 40 (i.e., when the pendulum 76 is contacting the contact B), the control section 62 does not output a reversing signal to the reversing portion 34, and does not reverse the relationships of connection between the row electrode driving circuit 32 and the row electrodes. When the control section 62 recognizes that the image display medium is positioned at the right side (i.e., when the pendulum 76 is contacting the contact A), the control section 62 outputs a reversing signal to the reversing portion 34, and causes the relationships of connection between the row electrode driving circuit 32 and the row electrodes to be reversed.

When the control section 62 recognizes that the image display medium is positioned at the upper side due to the sensing signal from the gravitational direction sensor 72 provided at the back surface substrate portion 52 (i.e., when the pendulum 76 is contacting the contact B), the control section 62 does not output a reversing signal to the reversing portion 46, and does not reverse the relationships of connection between the column electrode driving circuit 44 and the column electrodes. When the control section 62 recognizes that the image display medium is positioned at the lower side (i.e., when the pendulum 76 is contacting the contact A), the control section 62 outputs a reversing signal to the reversing portion 46, and causes the relationships of connection between the column electrode driving circuit 44 and the column electrodes to be reversed.

As a result, in the same way as in the first embodiment, the reference pixel positions of all of the image display media match, and the orientations of the images can be displayed normally.

In this way, in the present embodiment, the top, bottom, left, right positions of the display substrate portions 40 and the back surface substrate portions 52 are automatically sensed, and control is carried out such that the reference pixel positions of all of the image display media match. Therefore, it is possible to do away with operation of the reversing switches at the time of assembling the device or the time of dismantling the device, and the convenience of the device can be improved.

Note that, in the present embodiment, the gravitational direction sensors are used to sense the positions of the respective substrate portions. However, it suffices for the sensors to be able to sense the positions of the substrate portions, and, for example, other sensors such as pressure sensors, gyro sensors, or the like, may be used.

(Third Embodiment)

Next, a third embodiment of the present invention will be described. In the present embodiment, description will be given of a case in which an image is displayed normally by reversing the image data.

The structure of the image display medium relating to the present embodiment is similar to that illustrated in FIGS. 1A and 1B. Because the image display device and the like are similar to that shown in FIGS. 10A and 10B through FIG. 13, detailed description thereof will be omitted.

Figure 12:
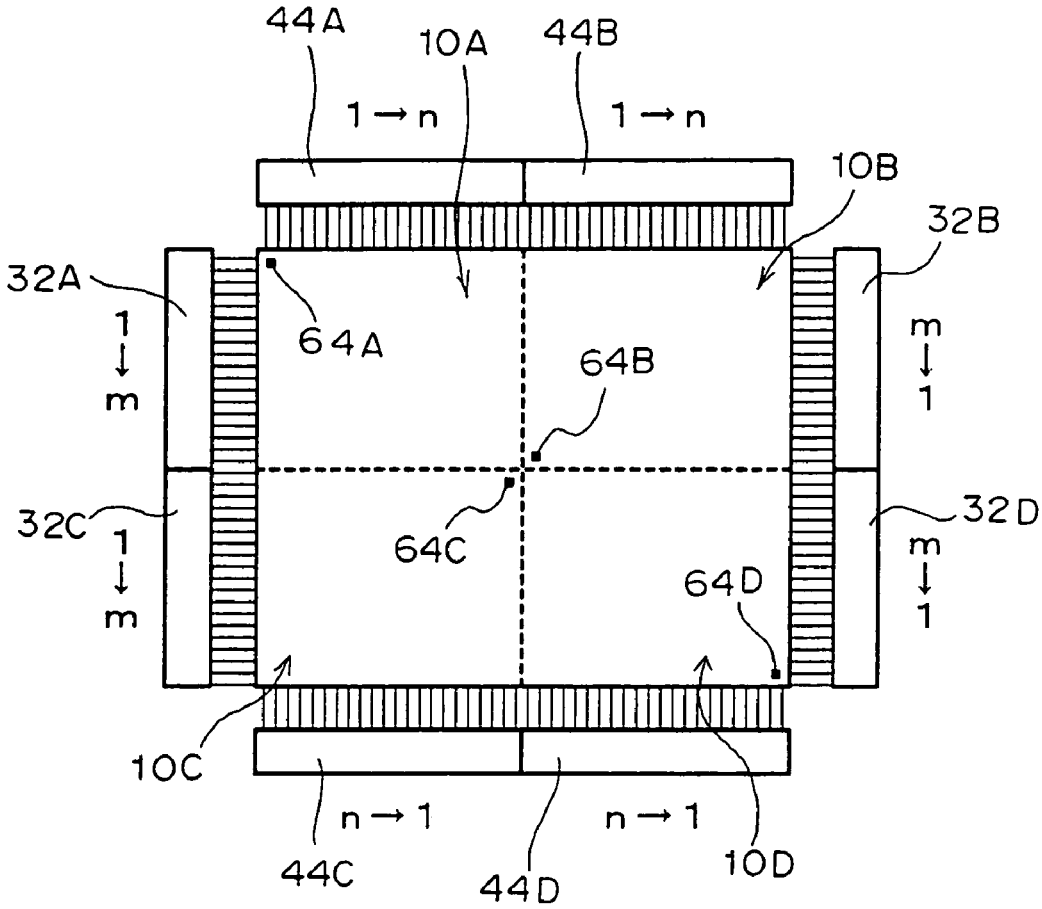
FIG. 12 is a diagram for explaining a reference pixel position relating to the conventional example.
Figure 13:
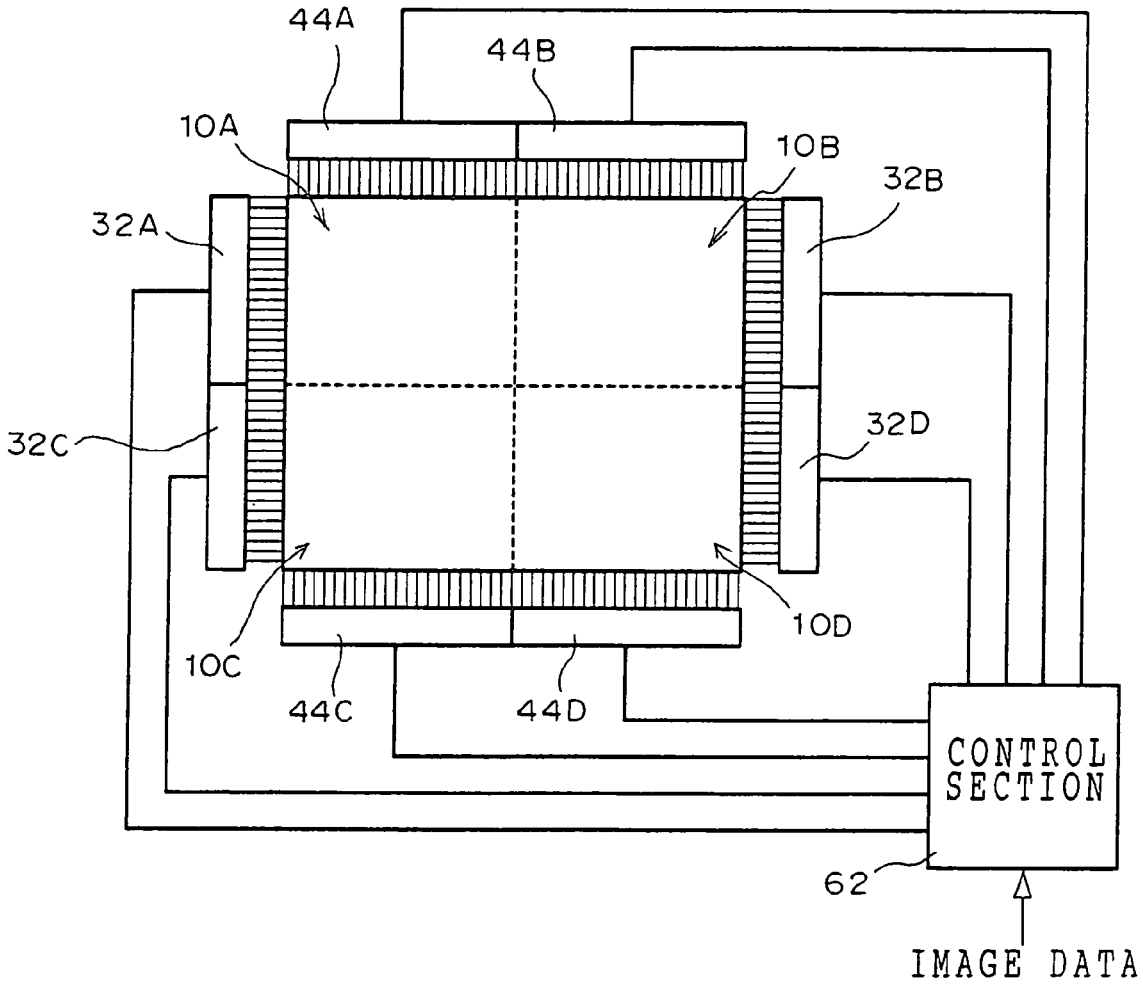
FIG. 13 is a schematic structural view of an image display device relating to the conventional example.

As shown in FIG. 12, at the image display media 10A~10D relating to the present embodiment, the reference pixel positions 64A~64D do not match. With this structure as it is, if, for example, a Japanese character is displayed at the respective image display media 10A~10D, as shown in FIG. 14, the orientations of the respective characters will not match, and the images will not be displayed normally.

Thus, the control section 62 reverses the image data for driving the image display media 10B–10D. The control section 62 controls the row electrode driving circuit 32 and the column electrode driving circuit 44 of the image display medium 10A on the basis of the usual image data. For the image display media 10B–10D, the control section 62 controls the row electrode driving circuits 32 and the column electrode driving circuits 44 corresponding to the image display media 10B~10D on the basis of reversed image data.

Specifically, as shown in FIG. 14, because the top and bottom of the image are reversed in terms of row order at the image display medium 10B, the control section 62 generates image data in which the column image data of the respective columns are reversed upside down. Further, as shown in FIG. 14, because the left and right of the image are reversed in terms of column order at the image display medium 10C, the control section 62 generates image data in which the row-line image data of the respective rows are reversed left and right. Moreover, as shown in FIG. 14, because the left and right and the top and bottom of the image are reversed in terms of row and column orders at the image display medium 10D, the control section 62 generates image data in which the column image data of the respective columns are reversed upside down and the row-line image data of the respective rows are reversed left and right.

By controlling the row electrode driving circuits 32 and the column electrode driving circuits 44 of the respective image display media on the basis of the image data generated in this way, the reference pixel positions all become positions in the upper left corner, and as shown in FIG. 6, the orientations of the respective characters are displayed normally.

Note that, when an image is displayed by using all of the image display media 10A~10D as a single screen, it suffices for the control section 62 to generate image data of divisional images formed by dividing the image to be displayed into four, and to carry out the above-described reversing operations on the generated divisional image data.

In this way, in the present embodiment, by reversing the image data by the control section 62, the orientations of the images are displayed normally. Therefore, there is no need to provide reversing portions at the display substrate portions 40 and the back surface substrate portions 52, and the device can be structured inexpensively.

Figure 9:
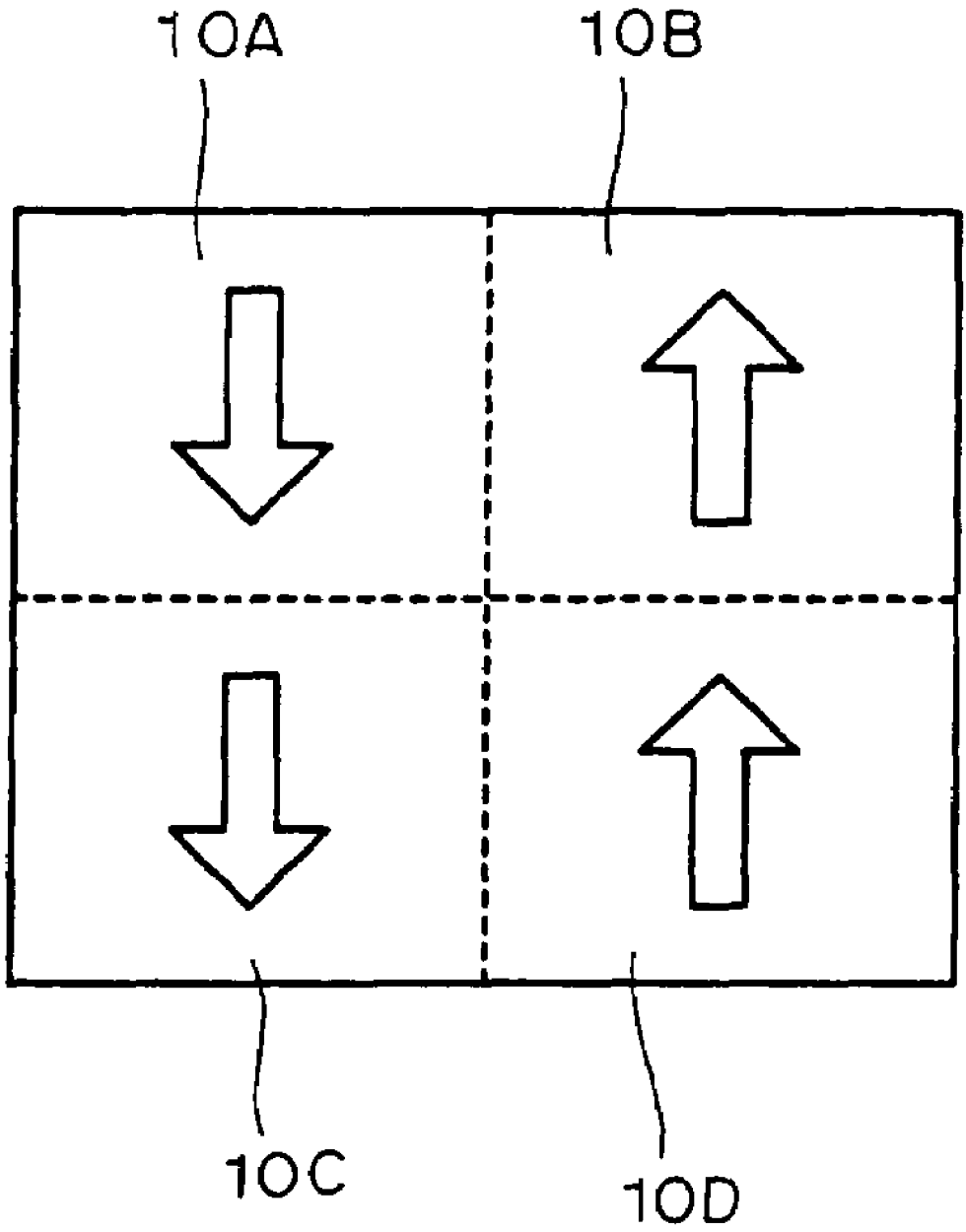
FIG. 9 is a diagram for explaining an order of scanning.
Figure 10A:
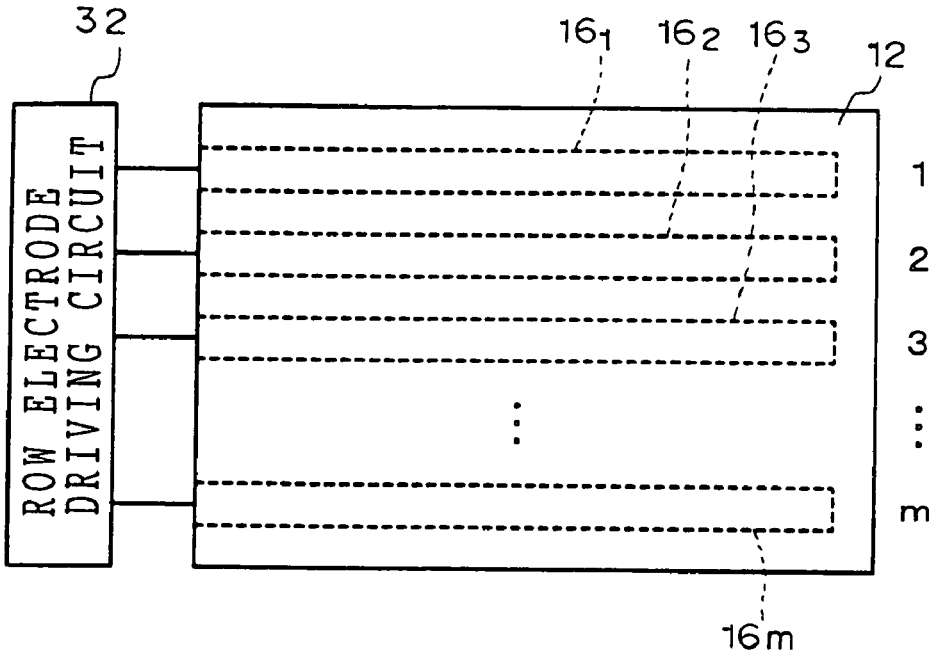
FIGS. 10A and 10B are sectional views of an image display medium relating to a conventional example.
Figure 10B:
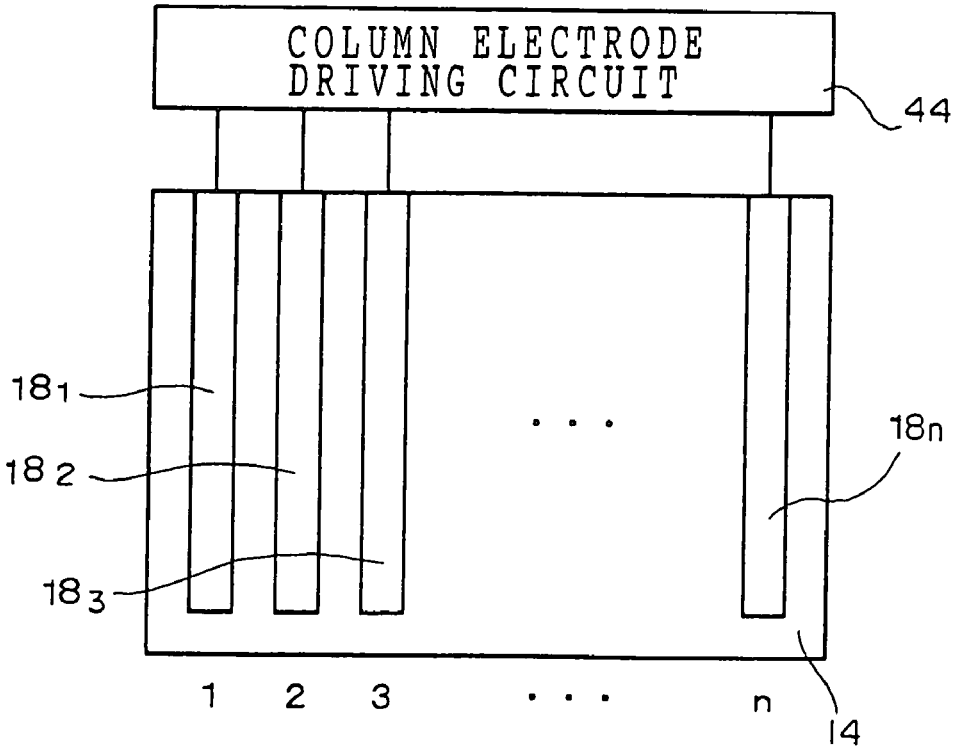
Figure 11:
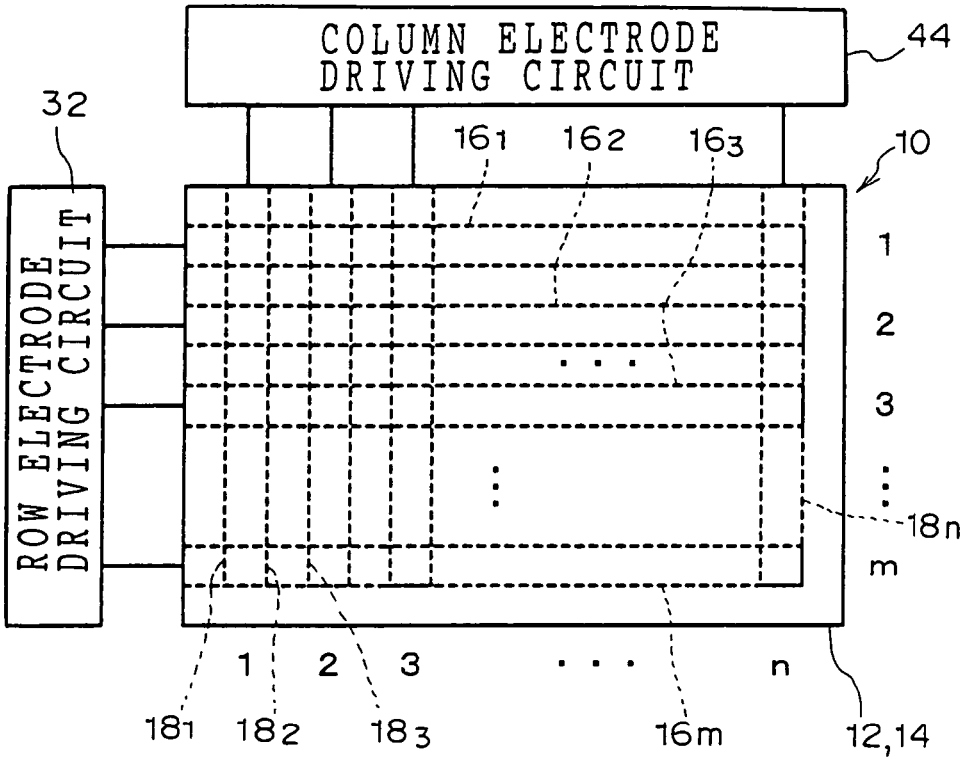
FIG. 11 is a diagram at the time when a display substrate and a back surface substrate relating to the conventional example are superposed together.

Note that, although the images are displayed with normal orientations by reversing the image data, the order of scanning, i.e., the order in which voltage is applied to the row electrodes, does not change. Therefore, as shown in FIG. 9, the scanning directions, which are shown by the arrows, of the image display media 10A, 10C are opposite to those of the image display media 10B, 10D. Although there are no problems in the case of high-speed scanning, there are cases in which a person viewing the image may experience a sense of lack of harmony, depending on the scanning speed.

In such a case, this problem can be overcome by using the image display device 60A described in the second embodiment. Namely, the reversing signal is outputted to the reversing portions 34 of the display substrate portions 40 corresponding to the image display media 10B, 10D, and the relationships of connection between the row electrode driving circuits 32 and the row electrodes are reversed. In this way, the scanning directions can be made to match at all of the image display media, and it is possible to prevent a person viewing the image from experiencing a sense of lack of harmony.

Note that, in each of the above-described embodiments, description is given of an image display device using four image display media in two lines and two columns. However, the number of lines and the number of columns is not limited to the same, and can be selected arbitrarily. Further, in the above embodiments, description is given of cases using image display media displaying images by movement of particles. However, the present invention can also be applied to image display media using liquid crystals. In addition, cases of single matrix driving type image display devices are described in the above embodiments. However, the present invention can also be applied to active matrix driving type image display devices.

As described above, in accordance with the present invention, there is obtained the excellent effect that, when a large screen is formed by utilizing a plurality of the same image display media, an image can be displayed normally.

What is claimed is:

1. An image display device comprising:

image display means at which a plurality of image display media are arranged side-by-side, the image display means including:

a display substrate portion having a display substrate at which a plurality of top-plane side electrodes are formed, and a top-plane side voltage applying means for applying voltage to the top-plane side electrodes;

a back surface substrate portion having a back surface substrate at which a plurality of backplane side electrodes are formed, and a backplane side voltage applying means for applying voltage to the backplane side electrodes; and display bodies sealed between the display substrate and the back surface substrate;

control means for controlling the top-plane side voltage applying means and the backplane side voltage applying means of the plurality of image display media on the basis of image data; and reference pixel position adjusting means for adjusting reference pixel positions such that the reference pixel positions match at the plurality of image display media, each of the reference pixel positions being determined by a reference top-plane side electrode, which is determined in advance from among the plurality of top-plane side electrodes, and a reference backplane side electrode, which is determined in advance from among the plurality of backplane side electrodes.

2. The image display device of claim 1, wherein the reference pixel position adjusting means has:

a plurality of top-plane side reversing means provided respectively at a plurality of the display substrate portions, and reversing first wiring connections between the plurality of top-plane side electrodes and the top-plane side voltage applying means;

a plurality of top-plane side reversal switching switches provided in correspondence with the plurality of top-plane side reversing means respectively, for turning a reversal operation by the top-plane side reversing means on and off;

a plurality of backplane side reversing means provided respectively at a plurality of the back surface substrate portions, and reversing second wiring connections between the plurality of backplane side electrodes and the backplane side voltage applying means; and a plurality of backplane side reversal switching switches provided in correspondence with the plurality of backplane side reversing means respectively, for turning a reversal operation by the backplane side reversing means on and off.

3. The image display device of claim 2, wherein the plurality of top-plane side electrodes have m row electrodes (row electrodes$_{1\text{-}m}$), and the first wiring connections include m wires (first wires$_{1\text{-}m}$), and the plurality of backplane side electrodes have n column electrodes (column electrodes$_{1\text{-}n}$), and the second wiring connections include n wires (second wires$_{1\text{-}n}$).

4. The image display device of claim 3, wherein, when the top-plane side reversal switching switch is off, the first wires$_{1\text{-}m}$ correspond to the row electrodes$_{1\text{-}m}$ respectively, and when the top-plane side reversal switching switch is on, the top-plane side reversing means changes a state of connection such that the first wires$_{1\text{-}m}$ correspond to the row electrodes$_{m\text{-}1}$ respectively.

5. The image display device of claim 3, wherein, when the backplane side reversal switching switch is off, the second wires$_{1\text{-}n}$ correspond to the column electrodes$_{1\text{-}n}$ respectively, and when the backplane side reversal switching switch is on, the backplane side reversing means changes a state of connection such that the second wires$_{1\text{-}n}$ correspond to the column electrodes$_{n\text{-}1}$ respectively.

6. The image display device of claim 1, wherein the reference pixel position adjusting means has an image data reversing means which reverses the image data on the basis of an arrangement of the plurality of image display media.

7. The image display device of claim 6, further comprising position detecting means for detecting placed positions of the image display media, and on the basis of the placed positions detected by the position detecting means, the reference pixel position adjusting means carries out adjustment such that the reference pixel positions match at the plurality of image display media.

8. The image display device of claim 1, further comprising position detecting means for detecting placed positions of the image display media, wherein, on the basis of the placed positions detected by the position detecting means, the reference pixel position adjusting means carries out adjustment such that the reference pixel positions match at the plurality of image display media.

9. The image display device of claim 1, wherein the image display means is structured such that four of the image display media are arranged in two lines and two columns.

10. The image display device of claim 9, wherein the reference pixel position adjusting means has:

position detecting means provided at each of the image display media, for detecting placed positions of the media;

top-plane side reversing means provided at the display substrate portion of each of the image display media, for reversing first wiring connections between the plurality of top-plane side electrodes and the top-plane side voltage applying means;

backplane side reversing means provided at the back surface substrate portion of each of the image display media, for reversing second wiring connections between the plurality of backplane side electrodes and the backplane side voltage applying means; and another control means for controlling the top-plane side reversing means and the backplane side reversing means on the basis of results of detection of the position detecting means.

11. The image display device of claim 10, wherein the plurality of top-plane side electrodes have m row electrodes (row electrodes$_{1\text{-}m}$), and the first wiring connections include m wires (first wires$_{1\text{-}m}$), and the plurality of backplane side electrodes have n column electrodes (column electrodes$_{1\text{-}n}$), and the second wiring connections include n wires (second wires$_{1\text{-}n}$).

12. The image display device of claim 11, wherein the other control means outputs to the top-plane side reversing means, in accordance with the results of detection of the position detecting means.

13. The image display device of claim 12, wherein, when the top-plane side reversing means has not received output from the control means, the top-plane side reversing means makes the first wires$_{1\text{-}m}$ correspond to the row electrodes$_{1\text{-}m}$ respectively, and when the top-plane side reversing means has received output from the control means, the top-plane side reversing means makes the first wires$_{1\text{-}m}$ correspond to the row electrodes$_{m\text{-}1}$ respectively.

14. The image display device of claim 11, wherein the another control means outputs to the backplane side reversing means, in accordance with the results of detection of the position detecting means.

15. The image display device of claim 14, wherein, when the backplane side reversing means has not received output from the control means, the backplane side reversing means makes the second wires$_{1\text{-}n}$ correspond to the column electrodes$_{1\text{-}n}$ respectively, and when the backplane side reversing means has received output from the control means, the backplane side reversing means makes the second wires$_{1\text{-}n}$ correspond to the column electrodes$_{n\text{-}1}$ respectively.

16. The image display device of claim 1, wherein the plurality of top-plane side electrodes and the plurality of back surfaces side electrodes are a simple matrix structure.

17. An image display device comprising:

image display means at which a plurality of image display media are arranged side-by-side, the image display means including:

a first substrate portion having a first substrate at which m row electrodes (row electrodes$_{i\text{-}m}$) are formed, and a first voltage applying means for applying voltage to the row electrodes;

a second substrate portion having a second substrate at which n column electrodes (column electrodes$_{1\text{-}n}$) are formed, and a second voltage applying means for applying voltage to the column electrodes; and display bodies sealed between the first substrate and the second substrate;

control means for controlling the first voltage applying means and the second voltage applying means of the plurality of image display media on the basis of image data; and reference pixel position adjusting means for adjusting reference pixel positions such that the reference pixel positions match at the plurality of image display media, each of the reference pixel positions being determined by a reference row electrode, which is determined in advance from among the m row electrodes, and a reference column electrode, which is determined in advance from among the n column electrodes.

18. The image display device of claim 17, wherein the reference pixel position adjusting means has:

first reversing means provided at the first substrate portion, for reversing first wiring connections between the m row electrodes and the first voltage applying means;

a first reversal switching switch provided so as to correspond to the first reversing means, for turning a reversal operation by the first reversing means on and off;

second reversing means provided at the second substrate portion, for reversing second wiring connections between the n column electrodes and the second voltage applying means; and a second reversal switching switch provided so as to correspond to the second reversing means, for turning a reversal operation by the second reversing means on and off.

19. The image display device of claim 18, wherein, when the first reversal switching switch is off, the first $wires_{1\text{-}m}$ correspond to the row $electrodes_{1\text{-}m}$ respectively, and when the first reversal switching switch is on, the first reversing means changes a state of connection such that the first $wires_{1\text{-}m}$ correspond to the row $electrodes_{m\text{-}1}$ respectively.

20. The image display device of claim 18, wherein, when the second reversal switching switch is off, the second $wires_{1\text{-}n}$ correspond to the column $electrodes_{1\text{-}n}$ respectively, and when the second reversal switching switch is on, the second reversing means changes a state of connection such that the second $wires_{1\text{-}n}$ correspond to the column $electrodes_{n\text{-}1}$ respectively.

* * * * *